United States Patent [19]

Aihara

[11] Patent Number: 5,020,975

[45] Date of Patent: Jun. 4, 1991

[54] VARIABLE-DELIVERY VANE-TYPE ROTARY COMPRESSOR

[75] Inventor: Toshinori Aihara, Kanagawa, Japan

[73] Assignee: Atsugi Motor Parts Company, Limited, Kanagawa, Japan

[21] Appl. No.: 396,843

[22] Filed: Aug. 21, 1989

[30] Foreign Application Priority Data

Aug. 22, 1988 [JP] Japan ..... 63-109832[U]

[51] Int. Cl.[5] ..... F04B 49/08

[52] U.S. Cl. ..... 417/295; 417/310

[58] Field of Search ..... 417/295, 310, 222 S

[56] References Cited

U.S. PATENT DOCUMENTS

| | | | |
|---|---|---|---|
| 4,813,854 | 3/1989 | Nakajima | 417/295 |
| 4,865,524 | 9/1989 | Nakajima | 417/310 |
| 4,892,466 | 1/1990 | Taguchi | 417/310 |

FOREIGN PATENT DOCUMENTS

| | | | |
|---|---|---|---|
| 0247185 | 10/1987 | Japan | 417/222 S |
| 62-265491 | 11/1987 | Japan . | |

*Primary Examiner*—Leonard E. Smith
*Assistant Examiner*—John A. Savio, III
*Attorney, Agent, or Firm*—Bachman & LaPointe

[57] ABSTRACT

In a variable-delivery vane-type rotary compressor, a rotational displacement of an adjust member relative to a front member fixedly closing a front end of a cam ring varies a compression starting point of a rotary vane in a working chamber formed in the cam ring. The rotational displacement of the adjust member is controlled by an adjust member actuating unit in response to a pilot pressure applied to the adjust member actuating unit from a pilot pressure applying unit. The pilot pressure applying unit includes a first passage communicating the adjust member actuating unit with a valve unit, a second passage communicating an induction chamber with the valve unit, and a third passage communicating a discharge chamber with the valve unit. The valve unit, when it is most displaced in a first direction, fully blocks the communication between the adjust member actuating unit and the induction chamber through the first and second passages while allowing the communication between the adjust member actuating unit and the discharge chamber through the first and third passages for applying a pressure within the discharge chamber to the adjust member actuating unit as the pilot pressure. On the other hand, the valve unit, when it is most displaced in a second direction opposite to the first direction, fully opens the communication between the adjust member actuating unit and the induction chamber through the first and second passages for applying a pressure within the induction chamber to the adjust member actuating unit as the pilot pressure.

10 Claims, 2 Drawing Sheets

VARIABLE-DELIVERY VANE-TYPE ROTARY COMPRESSOR

BACKGROUND OF THE INVENTION

1. Field of the Invention

The present invention relates generally to a variable-delivery vane-type rotary compressor. More specifically, the present invention relates to a variable-delivery vane-type rotary compressor to be used as a refrigerant compressor for an air conditioner of a vehicle.

2. Description of the Background Art

In a variable-delivery vane-type rotary compressor which is well known in the art, a rotational displacement of an adjust plate relative to a front plate which fixedly closes a front end of a cam ring, is controlled by an adjust plate actuating mechanism in response to a pilot pressure applied to the adjust plate actuating mechanism from a pilot pressure applying mechanism, so as to adjust a compression starting point of a rotary vane in a working chamber provided in the cam ring.

A First Japanese Patent publication No. 62-265491 discloses such a rotary compressor. In this publication, the front plate is formed with a pair of induction ports and a pair of by-pass ports, and is further formed with a pair of pressure operation chambers. The adjust plate is formed with a pair of by-pass openings and is further formed with a pair of pressure receiving projections. Each pressure receiving projection is slidably fitted into the corresponding pressure operation chamber to divide it into first and second pressure chambers. The first chamber is communicated with an induction chamber through the by-pass port to bias the pressure receiveing projection in a first direction. The first chamber is further provided with a spring so as to bias the pressure receiving projection also in the first direction. The second chamber is communicated with a discharge chamber through a first passage formed in the compressor and is further communicated with a valve unit through a second passage. A third passage communicates the induction chamber to the valve unit and a fourth passage communicates a discharge chamber to the valve unit. The valve unit comprises a ball valve and a plunger which is arranged in the fourth passage and constantly receives a pressure within the discharge chamber to bias the ball valve in one direction. The ball valve also receives a bias force from a biasing unit through the third passage so as to be biased in the other direction opposite to the one direction. The ball valve opens and closes the communication between the induction chamber and the second chamber in response to a differential between the bias force applied by the biasing unit and the pressure within the discharge chamber applied through the plunger. Specifically, when the bias force applied by the biasing unit is larger to displace the ball valve in the other direction, the communication between the second chamber and the induction chamber is fully established through the second and third passages so that the pressure within the induction chamber is applied to the second chamber, i.e. the pressure within the second chamber applied from the discharge chamber through the first passage is released through the second and third passages into the induction chamber. Accordingly, the pressure within the induction chamber is applied to the second chamber as the pilot pressure to bias the pressure receiving projection in a second direction opposite to the first direction. On the other hand, when the pressure within the discharge chamber applied by the plunger is larger to displace the ball valve in the one direction, the communication between the second chamber and the induction chamber is blocked so that the pressure within the second chamber applied from the discharge chamber through the first passage is prevented from releasing. Accordingly, the pressure within the discharge chamber is applied to the second chamber as the pilot pressure to bias the pressure receiving projection in the second direction.

In response to a differential between the applied pilot pressure in the second chamber and the sum of the pressure within the induction chamber and the spring force in the first chamber, the pressure receiving projection slides in the pressure operation chamber in the first and second directions so as to control the rotational displacement of the adjust plate relative to the front plate to adjust the compression starting point of the rotary vane.

In the structure described above, however, since no pressure is applied through the fourth passage and through the second passage into the second chamber even when the communication between the second chamber and the induction chamber through the second and third passages is fully closed. This necessitates the first passage in addition to the fourth passage wherein the plunger is provided. Accordingly, the structure inevitably becomes complicated and costly.

SUMMARY OF THE INVENTION

Therefore, it is an object of the present invention to provide a variable-delivery vane-type rotary compressor which can control a rotational displacement of an adjust member relative to a front member fixedly closing a front end of a cam ring to adjust a compression starting point of a rotary vane, with simpler and less costly structure.

To accomplish the above-mentioned and other objects, according to one aspect of the present invention, a variable-delivery vane-type rotary compressor comprises a cam ring, a front member closing a front end of the cam ring and having first opening means, a rear member closing a rear end of the cam ring, a rotor rotatably provided in the cam ring between the front and rear members to define working chamber means in the cam ring, the rotor having a plurality of vanes each of which is reciprocatively mounted to the rotor for compressing working fluid introduced from an induction chamber provided in the compressor into the working chamber means through the first opening means and for discharging the compressed working fluid from the working chamber means into a discharge chamber provided in the compressor, an adjust member having second opening means, said adjust member rotatably provided in the cam ring between the rotor and the front member, a rotational displacement of the adjust member changing a position of the second opening means relative to the first opening means so as to vary a compression starting point of the vane in the working chamber means, and adjust member actuating means, provided in the compressor, for controlling the rotational displacement of the adjust member in response to a pilot pressure applied to the adjust member actuating means from pilot pressure applying means provided in the compressor.

The pilot pressure applying means includes first passage means communicating the adjust member actuating means with valve means, second passage means communicating the induction chamber with the valve means, third passage means communicating the discharge chamber with the valve means, and biasing means for biasing the valve means in a first direction through the second passage means, the biasing means varying its biasing force in response to a pressure within the induction chamber applied thereto.

The valve means is applied with a pressure within the discharge chamber through the third passage means to be biased in a second direction opposite to the first direction.

The valve means is movable in response to a differential between the biasing force and the pressure applied to the valve means, between a first position where the valve means is most displaced in the second direction and fully blocks the communication between the adjust member actuating means and the induction chamber through the first and second passage means while allowing the communication between the adjust member actuating means and the discharge chamber through the first and third passage means for applying the pressure within the discharge chamber to the adjust member actuating means as the pilot pressure, and a second position where the valve means is most displaced in the first direction and fully opens the communication between the adjust member actuating means and the induction chamber through the first and second passage means for applying the pressure within the induction chamber to the adjust member actuating means as the pilot pressure.

BRIEF DESCRIPTION OF THE DRAWINGS

The present invention will be understood more fully from the detailed description given hereinbelow and from the accompanying drawings of the preferred embodiment of the invention, which are given by way of example only, and are not intended to be limitative of the present invention.

In the drawings.

DESCRIPTION OF THE PREFERRED EMBODIMENT

A preferred embodiment of a vane-type rotary compressor will be described with reference to FIGS. 1 and 2, wherein the compressor is a concentric type variable-delivery compressor and is to be used as a refrigerant compressor for an air conditioner of a vehicle.

Figure 1:
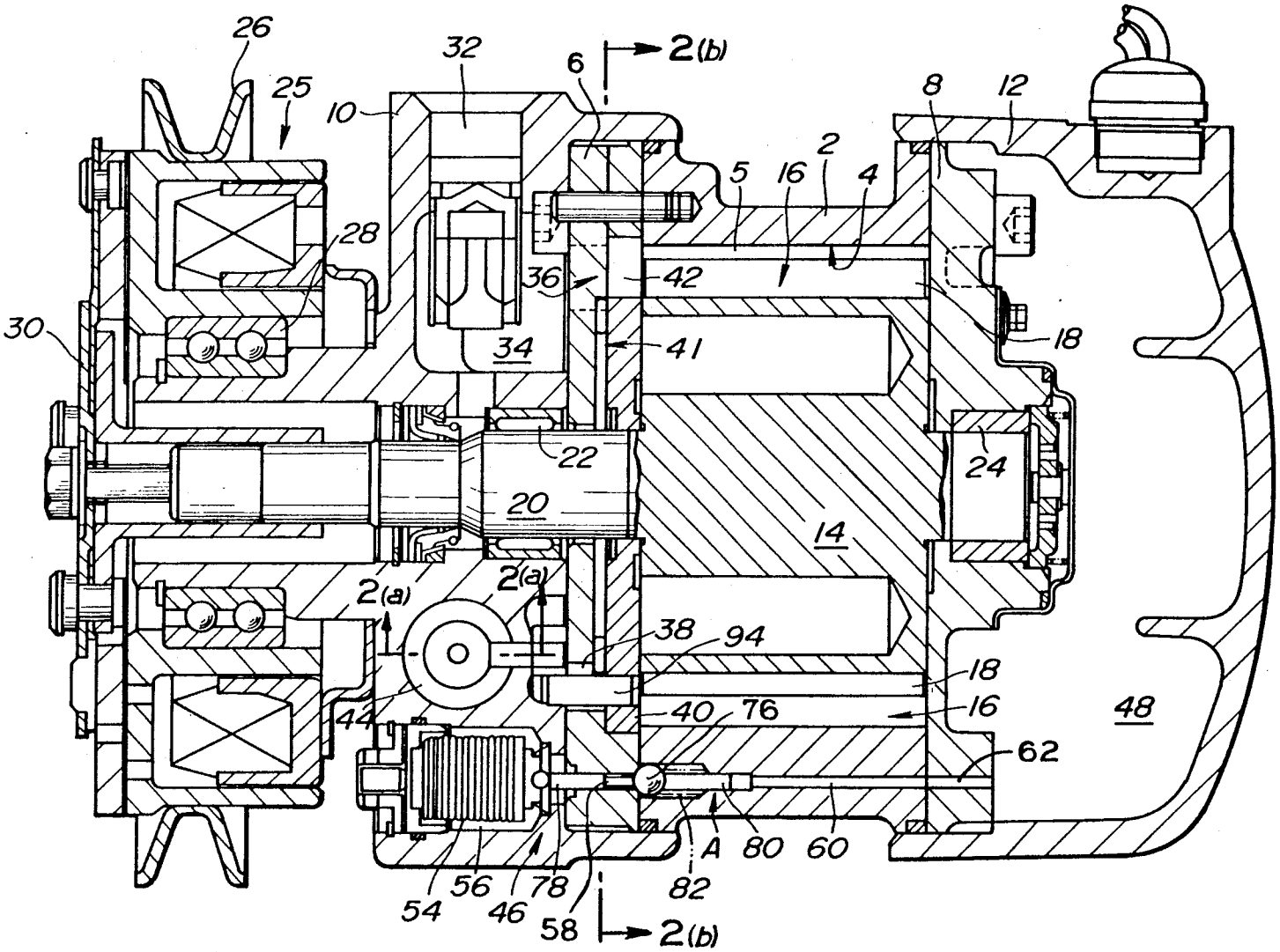
FIG. 1 is a longitudinal section showing a variable-delivery vane-type rotary compressor according to a preferred embodiment of the present invention.

In FIG. 1, a cam ring 2 has a cam surface 4 on its inner circumference. The cam surface 4 defines therein an axial space 5 which is of an elliptical shape in cross section. Front and rear ends of the cam ring 2 are fixedly closed by a front plate 6 and a rear plate 8, respectively. The front plate 6 is further fixed to a head cover 10 which is also fixed to a front end of the outer periphery of the cam ring 2. Similarly, the rear plate 8 is further fixed to a rear cover 12 which is also fixed to a rear end of the outer periphery of the cam ring 2.

A cylindrical rotor 14 is rotatably received in the elliptical space 5 to define a pair of working chambers 16 in the elliptical space 5, i.e. inside the cam ring 2. The working chambers 16 are formed at opposite locations to each other with respect to the axis of the rotor 14, each having a sickle-shape in section. The rotor 14 is provided with a plurality of vanes 18 each of which is reciprocatively inserted in a corresponding slit formed in the rotor 14 and is constantly in slidable contact with the cam surface 4 at its tip during rotation of the rotor 14.

A rotating shaft 20 is integrally formed with the rotor 14 and is rotatably supported by the head cover 10 and the rear plate 8 by means of bearings 22, 24. Onto a boss portion of the head cover 10 is mounted an electromagnetic clutch 25 through a bearing 28. The clutch 25 has a pulley 26 connected to the rotating shaft 20 through a clutch plate 30 so as to transmit the torgue from the engine to the rotating shaft 20. When the pulley 26 is rotated by the engine to rotate the rotor 14 through the rotating shaft 20, the vanes 18 project radially due to centrifugal force applied thereto and back pressure of the vanes 18, so that the tips of the vanes get constantly in contact with the cam surface 4 of the cam ring 2 during the rotation of the rotor.

The head cover 10 is formed therein with an inlet port 32 which receives the working fluid, i.e. the refrigerant from an evaporator, and an induction chamber 34 communicating with the inlet port 32. The front plate 6 is formed therethrough with a pair of induction ports 36 and a pair of by-pass ports 38. The induction ports 36 are formed at opposite locations to each other with respect to the axis of the rotor 14 and the by-pass ports 38 are also formed at opposite locations to each other with respect to the axis of the rotor 14. The induction ports 36 and the by-pass ports 38 are constantly in communication with the induction chamber 34.

Between the rotor 14 and the front plate 6 is provided an adjust plate 40 which is fitted in a central circular recess 41 of the front plate 6 and is rotatable about the rotating shaft 20. The adjust plate 40 is formed with a pair of by-pass openings 42 in the form of cut-outs formed at the periphery of the adjust plate 40 as shown in FIG. 2(*b*). The by-pass openings 42 are located oppositely to each other with respect to the axis of the rotor 14. The adjust plate 40 is actuated by an adjust plate actuating unit 44 to which a pilot pressure is applied by a pilot pressure applying unit 46, which will be described later. By rotating the adjust plate 40, a position of each by-pass opening 42 relative to the corresponding induction port 36 and by-pass port 38 is varied to adjust a compression starting point of the vane so as to control a discharge of the pressurized refrigerant to be discharged from the working chambers 16 into a discharge chamber 48 defined between the rear plate 8 and the rear cover 12. Specifically, when the by-pass openings 42 are in communication with only the induction ports 36 and not in communication with the by-pass ports 38, since the working refrigerant introduced into the working chambers 16 through the induction chamber 34, the induction ports 36 and the by-pass openings 42 is prevented from escaping or bypassing through the by-pass ports 38, the compression starting point is most advanced so that the discharge of the pressurized refrigerant is maximum. On the other hand, as the adjust plate 40 is rotated to communicate the by-pass openings 42 with the by-pass ports 38, the bypass amount of the working refrigerant through the by-pass openings 42 and the by-pass ports 38 gets larger to retard the compression starting point of the vane, so that the discharge of the pressurized refrigerant gets less. The pressurized refrigerant is discharged from the working chambers 16 into the discharge chamber 48 through a pair of discharge ports 50 formed in the cam ring 2 between the cam surface 4 and the outer periphery of the cam ring 2, and through a discharge valve 52 provided in the corresponding discharge port 50, in accordance with the pressure generated in the working chambers 16.

Figure 2B:
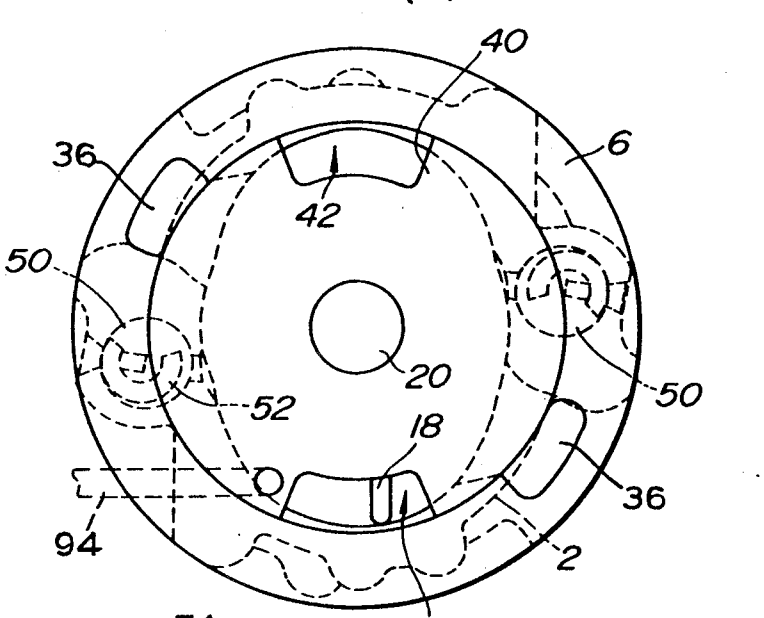
FIGS. 2(*a*), 2(*b*) and 2(*c*) are explanatory views showing the structural relationship among an adjust plate, an adjust plate actuating unit and a pilot pressure control unit according to the preferred embodiment of the present invention.
Figure 2C:
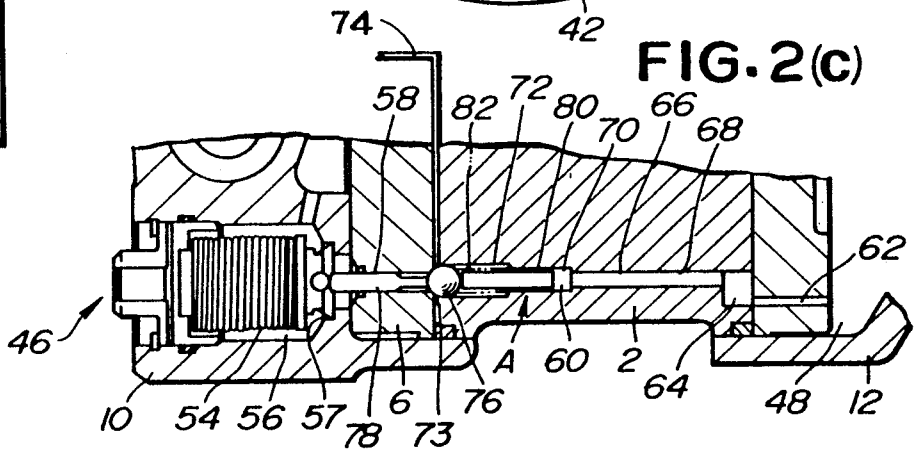
Figure 2A:
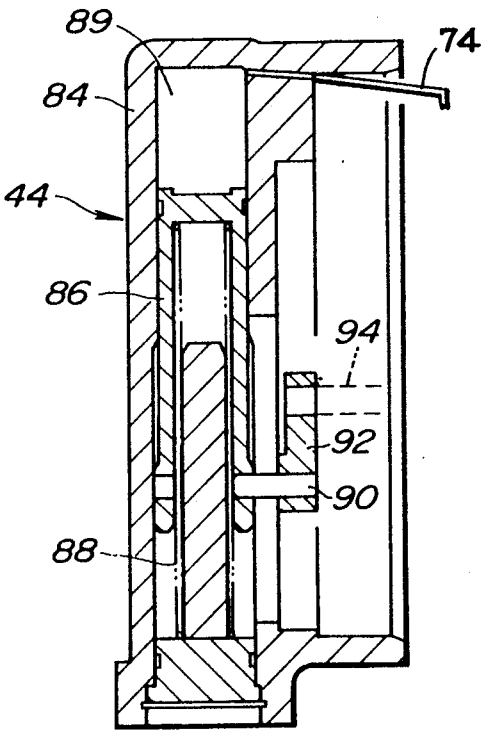

As shown in FIG. 2(*c*), the pilot pressure control unit 46 includes a bellows 54 which is contractedly provided in an induction pressure chamber 56. The induction pressure chamber 56 is formed in the head cover 10 and is introduced with the induction pressure from the induction chamber 34. The bellows 54 is urged by a set spring 57 forwardly, i.e. to the left in FIG. 2(*c*). An induction pressure passage 58 is formed in the front plate 6, extending rearwardly from the induction pressure chamber 56. A discharge pressure passage 60 is formed in the cam ring 2 and the rear plate 8, extending forwardly from the discharge chamber 48 to the induction pressure passage 58. The discharge pressure passage 60 has a small diameter section 62, a large diameter section 64 and a stepped section 66. The stepped section 66 has a first small diameter portion 68 extending forwardly from the large diameter section 64, a second portion 70, extending forwardly from the first portion 68, of a diameter larger than that of the first portion 68 and a third portion 72 of a diameter larger than that of the second portion 70. The third portion 72 extends forwardly from the second portion and joins the induction pressure passage 58 at its forward end. At the joining portion 73 of the induction pressure passage 58 and the third portion 72 of the discharge pressure passage 60, a pilot pressure passage 74 is formed connecting the joining portion 73 to the adjust plate actuating unit 44, which will be described later. A ball valve 76 is arranged at the joining portion 73 so as to control the communication between the induction pressure passage 58, i.e. the induction pressure chamber 56 and the pilot pressure passage 74, i.e. the adjust plate actuating unit 44. Specifically, the ball valve 76 receives at its one side an expansion force of the bellows 54 through a needle valve 78 which is connected to the bellows 54 at its forward end, i.e. at its left end in FIG. 2(c). The ball valve 76 receives at its other side the pressure within the discharge chamber 48 through a plunger 80 and further receives an expansion force of a spring 82 which is contractedly disposed between the ball valve 76 and a stepped portion where the second and third portions 70, 72 of the discharge pressure passage 60 join, so as to bias the ball valve 76 toward the induction pressure passage 58. The plunger 80 is disposed in the second and third portions 70 and 72 with a clearance between the plunger 80 and the walls of the second and third portions 70 and 72 of the discharge pressure passage 60. The clearance between the plunger 80 and the wall of the second portion 70 constitutes a throttle portion A for the pressure introduced into the discharge pressure passage 60 from the discharge chamber 48, as shown in FIG. 2(*c*). The maximum displacement of the plunger 80 toward the discharge chamber 48 is difined by a stepped portion between the first and second portions 68 and 70.

The adjust plate actuating unit 44 includes a cylinder 84 which is arranged in the head cover 10. A piston 86 is slidably received within the cylinder 84. The piston 86 is applied at its one side with a return force of a spring 88 which is contractedly disposed between the piston 86 and a bottom of the cylinder 84 as well as the induction pressure introduced from the induction chamber 34. The piston 86 is applied at its other side 89 with the pilot pressure introduced from the pilot pressure applying unit 46 through the pilot pressure passage 74. A pin 90 is fixed to the piston 86 to move integrally with the piston 86. A link 92 is at its one end pivotably mounted onto the pin 90 and is at its other end connected to the adjust plate 40 through a pin 94 which passes through one of the by-pass ports 38 formed in the front plate 6.

Now the operation of the variable-delivery vane-type rotary compressor according to the preferred embodiment will be described hereinbelow.

When the compressor is operated under the constant heat load condition, the pressure within the discharge chamber 48 is set substantially the same. Under this condition, when the compressor is operated at a low rotational speed, since the pressure within the induction chamber 34 is relatively high, i.e. the pressure within the induction pressure chamber 56 is relatively high, the force applied to the ball valve 76 by the plunger 80 and the spring 82 overcomes the expansion force of the bellows 54. Accordingly, the ball valve 76 is biased toward the induction pressure passage 58 to block the communication between the induction pressure chamber 56 and the other side 89 of the piston 86 so that the pressure within the discharge chamber 48 is applied to the other side 89 of the piston 86 as the pilot pressure through the throttle portion A, through the clearance between the ball valve 76 and the wall of the third portion 72 of the discharge pressure passage 60 and through the pilot pressure passage 74. This causes the piston 86 to move downward in FIG. 2(*a*) to rotate the adjust plate 40 in one direction. In case the piston 86 reaches the most downward position in FIG. 2(*a*), the by-pass openings 42 of the adjust plate 40 fully matches the corresponding induction ports 36 and the communication between the working chambers 16 and the induction chamber 34 through the by-pass ports 38 of the front plate 6 is fully closed. Thus, the compression starting point of the vane is most advanced to render the discharge of the pressurized refrigerant maximum. On the other hand, when the compressor is operated at a high rotational speed, since the pressure within the induction chamber 34 is relatively low, i.e. the pressure within the induction pressure chamber 56 is relatively low, the expansion force of the bellows 54 overcomes the force applied to the ball valve 76 by the plunger 80 and the spring 82. Accordingly, the ball valve 76 is biased toward the discharge chamber 48 to open the communication between the induction pressure chamber 56 and the other side 89 of the piston 86 so that the pressure within the induction pressure chamber 56 is applied to the other side 89 of the piston 86. This causes the piston 86 to move upward in FIG. 2(*a*) to rotate the adjust plate 40 in the opposite direction. In case the piston 86 reaches the most upward position in FIG. 2(*a*) the by-pass openings 42 of the adjust plate 40 fully matches the corresponding by-pass ports 38 so that the compression starting point of the vane is most retarded to render the discharge of the pressurized refrigerant minimum. The intermediate positions of the piston 86 between its highest and lowest positions in FIG. 2 occur in accordance with the balanced position of the ball valve 76, i.e. the opening degree of the induction pressure passage 58 relative to the pilot pressure passage 74. In these intermediate positions of the piston 86, the position of the by-pass openings 42 of the adjust plate 40 relative to the by-pass ports 38 of the front plate 4 is set between the most advanced compression starting point and the most retarded compression starting point so as to control the compression starting point of the vane in accordance with the compressor operation speed.

When the compressor is not operated, the piston 86 moves to its highest position in FIG. 2(*a*) by the force of the spring 88 so that the position of the by-pass openings 42 of the adjust plate 40 relative to the by-pass ports 38 of the front plate 6 is set corresponding to the most retarded compression starting point of the vane.

On the other hand, when the heat load applied to the compressor varies, for example, to a higher load, the pressure within the discharge chamber 48 becomes also higher. Since this higher pressure is applied to the ball valve 76 through the plunger 80, the larger expansion force of the bellows 54 is required, i.e. the lower induction pressure within the induction pressure chamber 56 is required in order to apply the pressure within the induction pressure chamber 56 to the other side 89 of the piston 86 so as to retard the comression starting point of the vane. Accordingly, the adjustment of the compression starting point is automatically performed also in accordance with the heat load applied to the compressor, i.e. in accordance with the required cooling effect of the compressor.

It is to be understood that the invention is not to be limited to the embodiments described above, and that various changes and modifications may be made without departing from the spirit and scope of the invention as defined in the appended claims. For example, though in the above described embodiment the ball valve does not fully block the communication between the discharge chamber and the adjust plate actuating unit during its possible displacement, it is possible to modify the structure such that the ball valve fully blocks the communication between the discharge chamber and the adjust plate actuating unit when the opening degree of the induction pressure passage relative to the pilot pressure passage becomes maximum.

What is claimed is:

1. A variable-delivery vane-type rotary compressor comprising:

a cam ring;

a front member closing a front end of said cam ring, said front member having first opening means;

a rear member closing a rear end of said cam ring;

a rotor rotatably provided in said cam ring between said front and rear members to define working chamber means in said cam ring, said rotor having a plurality of vanes each of which is reciprocatively mounted to said rotor for compressing working fluid introduced from an induction chamber provided in said compressor into said working chamber means through said first opening means and for discharging the compressed working fluid from said working chamber means into a discharge chamber provided in said compressor;

an adjust member having second opening means, said adjust member rotatably provided in said cam ring between said rotor and said front member, a rotational displacement of said adjust member changing a position of said second opening means relative to said first opening means so as to vary a compression starting point of the vane in said working chamber means;

adjust member actuating means, provided in said compressor, for controlling said rotational displacement of the adjust member in response to a pilot pressure applied to said adjust member actuating means from pilot pressure applying means provided in said compressor;

said pilot pressure applying means including:

first passage means communicating said adjust member actuating means with valve means;

second passage means communicating said induction chamber with said valve means;

third passage means communicating said discharge chamber with said valve means;

biasing means for biasing said valve means in a first direction through said second passage means, said biasing means varying its biasing force in response to a pressure within said induction chamber applied thereto;

said valve means including a valve member and a plunger, said plunger provided in said third passage means with a clearance between said plunger and walls of said third passage means to define a throttle portion therebetween, said plunger receiving a pressure within said discharge chamber through said third passage means for biasing said valve member in a second direction opposite to said first direction;

said valve member being movable in response to a differential between said biasing force applied to said valve member through said biasing means and said pressure applied to said valve member through said plunger, between a first position where said valve member is most displaced in said second direction and fully blocks the communication between said adjust member actuating means and said induction chamber through said first and second passage means while allowing the communication between said adjust member actuating means and said discharge chamber through said first and third passage means for applying said pressure within said discharge chamber to said adjust member actuating means through said throttle portion as said pilot pressure, and a second position where said valve member is most displaced in said first direction and fully opens the communication between said adjust member actuating means and said induction chamber through said first and second passage means for applying said pressure within said induction chamber to said adjust member actuating means as said pilot pressure.

2. A variable-delivery vane-type rotary compressor as set forth in claim 1, wherein said valve member is a ball valve.

3. A variable-delivery vane-type rotary compressor as set forth in claim 1, wherein displacement of said plunger in said first direction beyond said second position is prevented by a stepped portion formed in said third passage means.

4. A variable-delivery vane-type rotary compressor as set forth in claim 1, wherein said biasing means includes a bellows provided in an induction pressure chamber formed in said second passage means, said bellows expanding to make said biasing force larger when the pressure within said induction pressure chamber gets smaller and contracting to make said biasing force smaller when the pressure within said induction pressure chamber gets larger.

5. A variable-delivery vane-type compressor as set forth in claim 4, wherein said biasing force of said bellows is applied to said valve member through a needle valve fixed to said bellows.

6. A variable-delivery vane-type compressor as set forth in claim 1, wherein said adjust member actuating means includes a piston which is reciprocatively provided within a cylinder, said piston being biased by a spring force in one direction and being adapted to be biased by said pilot pressure in the other direction opposite to said one direction, said piston being movable in response to a differential between said spring force and said pilot pressure so as to control said rotational displacement of said adjust member through linkage means connecting said piston to said adjust member.

7. A variable-delivery vane-type rotary compressor as set forth in claim 1, wherein said adjust member actuating means includes a piston which is reciprocatively provided within a cylinder to define a first chamber and a second chamber within said cylinder, said first and second chambers being located oppositely to each other with respect to said piston, said first chamber being provided therein with spring means for biasing said piston in one direction, said first chamber communicating with said induction chamber to be applied with the pressure within said induction chamber for biasing said piston in said one direction, said second chamber being applied with said pilot pressure for biasing said piston in the other direction opposite to said one direction, said piston being movable in response to a differential between said pilot pressure and the sum of said spring force and said pressure applied from said induction chamber so as to control said rotational displacement of said adjust member through linkage means connecting said piston to said adjust member.

8. A variable-delivery vane-type rotary compressor as set forth in claim 7, wherein said linkage means includes a first pin mounted to said piston, said first pin extending in a direction perpendicular to a direction of the reciprocative movement of the piston and extending along a rotational axis of said rotor, said linkage means further including a second pin mounted to said adjust member, said second pin being disaligned with said first pin and extending along the rotational axis of the rotor, said linkage means further including a link member connecting said first and second pins, said link member being pivotable about said first pin.

9. A variable-delivery vane-type rotary compressor as set forth in claim 8, wherein said second pin passes through said first opening means of said front member which is provided between said link member and said adjust member.

10. A variable-delivery vane-type rotary compressor as set forth in claim 1, wherein said valve member is further biased in said second direction by spring means provided in said third passage means, and wherein said valve member is movable between said first and second positions in response to a differential between said biasing force of the biasing means and the sum of said spring force and said pressure applied through said plunger.

* * * * *